US009605225B2

(12) United States Patent
Nakagawa et al.

(10) Patent No.: US 9,605,225 B2
(45) Date of Patent: Mar. 28, 2017

(54) METHOD FOR PREPARING BLAST FURNACE BLOW-IN COAL

(71) Applicant: MITSUBISHI HEAVY INDUSTRIES, LTD., Tokyo (JP)

(72) Inventors: Keiichi Nakagawa, Tokyo (JP); Setsuo Omoto, Tokyo (JP); Masakazu Sakaguchi, Tokyo (JP); Tsutomu Hamada, Tokyo (JP)

(73) Assignee: MITSUBISHI HEAVY INDUSTRIES, LTD., Tokyo (JP)

( * ) Notice: Subject to any disclaimer, the term of this patent is extended or adjusted under 35 U.S.C. 154(b) by 90 days.

(21) Appl. No.: 14/412,785

(22) PCT Filed: Sep. 13, 2013

(86) PCT No.: PCT/JP2013/074826

§ 371 (c)(1),
(2) Date: Jan. 5, 2015

(87) PCT Pub. No.: WO2014/057768

PCT Pub. Date: Apr. 17, 2014

(65) Prior Publication Data

US 2015/0218477 A1 Aug. 6, 2015

(30) Foreign Application Priority Data

Oct. 9, 2012 (JP) ..... 2012-224167

(51) Int. Cl.
*C21B 5/00* (2006.01)
*C10L 5/36* (2006.01)
(Continued)

(52) U.S. Cl.
CPC ..... *C10L 5/366* (2013.01); *C10B 53/04* (2013.01); *C10B 57/04* (2013.01); *C10L 9/08* (2013.01);
(Continued)

(58) Field of Classification Search
CPC ..... C21B 5/003; C21B 5/007; C10L 5/366; C10B 53/04; C10B 57/04
See application file for complete search history.

(56) References Cited

U.S. PATENT DOCUMENTS 4,428,769 A * 1/1984 Limpach ..... C21B 5/003 75/460

FOREIGN PATENT DOCUMENTS

CN 101451070 * 6/2009
CN 101476003 A 7/2009
(Continued)

OTHER PUBLICATIONS

Shizhuang, Shi et al. CN 101451070 A published Jun. 2009. Machine translation.*

(Continued)

*Primary Examiner* — George Wyszomierski
*Assistant Examiner* — Tima M McGuthry Banks
(74) *Attorney, Agent, or Firm* — Westerman, Hattori, Daniels & Adrian, LLP

(57) ABSTRACT

Provided is a method for preparing blast furnace blow-in coal that can, at a low cost, obtain blast furnace blow-in coal that suppresses occlusion by blast furnace blow-in ash or accretion of blast furnace blow-in ash in a pathway leading to a tuyere of a blast furnace main body, while suppressing a decrease in the amount of heat release. The method includes selecting first and second coal types satisfying conditions (S2, S3), on the basis of the CaO content in the ash when the oxides of Al, Si, Ca, and Mg in the ash is 100 wt % and the $Al_2O_3$ content in the ash is 20 wt %, deriving the mixing ratio of the first and second coal types that results in the CaO content in the ash of the mixed coal being at least 40 wt % (S4), and mixing the first and second coal types (S5) at the mixing ratio.

3 Claims, 3 Drawing Sheets

(51) Int. Cl.

| | |
|---|---|
| ***C10B 53/04*** | (2006.01) |
| ***C10B 57/04*** | (2006.01) |
| ***C10L 9/08*** | (2006.01) |

(52) U.S. Cl.

CPC ..... *C21B 5/003* (2013.01); *C21B 5/007* (2013.01); *C10L 2290/02* (2013.01); *C10L 2290/24* (2013.01); *C10L 2290/60* (2013.01)

(56) References Cited

FOREIGN PATENT DOCUMENTS

| | | | | |
|---|---|---|---|---|
| CN | 101638600 | A | * | 2/2010 |
| CN | 103060054 | A | * | 4/2013 |
| JP | 57-79103 | A | | 5/1982 |
| JP | 3-291313 | A | | 12/1991 |
| JP | 5-156330 | A | | 6/1993 |
| JP | 06-330114 | A | | 11/1994 |
| JP | 2001-294911 | A | | 10/2001 |
| JP | 2001-323307 | A | | 11/2001 |
| JP | 2005-68474 | A | | 3/2005 |

OTHER PUBLICATIONS

Jiali, Liu et al. CN 101638600 A published Feb. 2010. Machine translation.*

Jiang, S et al. CN 103060054 A published Apr. 2013. Machine translation.*

International Search Report dated Oct. 22, 2013, issued in counterpart application No. PCT/JP2013/074826, with Forms PCT/IB/338, PCT/IB/373, PCT/ISA/237, and PCT/ISA/220, with English translation (16 pages).

Office Action dated Jan. 12, 2016, issued in counterpart Chinese Patent Application No. 201380038858.0, with English translation. (11 pages).

* cited by examiner

METHOD FOR PREPARING BLAST FURNACE BLOW-IN COAL

TECHNICAL FIELD

The present invention relates to a method for preparing blast furnace blow-in coal.

BACKGROUND ART

Blast furnace installations have been configured so as to be capable of producing pig iron from iron ore by charging a starting material such as iron ore, limestone, or coke from the top of the blast furnace main body into the interior and blowing hot air and blast furnace blow-in coal (pulverized coal) as auxiliary fuel from a tuyere on the bottom side on the side of a blast furnace main body.

To stably operate the above blast furnace installation, the blast furnace blow-in coal must suppress accretion of blast furnace blow-in ash or occlusion by that blast furnace blow-in ash in a pathway leading to the tuyere of the blast furnace main body.

For example, it has been proposed to improve combustibility of blast furnace blow-in coal by adding a CaO-based flux such as limestone or serpentinite to pulverized coal of which the softening point of the pulverized coal ash is less than 1300° C., thereby adjusting the softening point of the ash in the pulverized coal to higher than or equal to 1300° C., and then blowing only the pulverized coal of which the softening point of the pulverized coal ash is higher than or equal to 1300° C. into the interior from a tuyere of a blast furnace main body (for example, refer to Patent Document 1 below).

Furthermore, a blast furnace operating method has been proposed, wherein, for example, any one or two or more types of CaO-based, MgO-based and $SiO_2$-based flux are blown into the interior of a blast furnace from a tuyere (for example, refer to Patent Document 2 below).

CITATION LIST

Patent Literature

Patent Document 1: Japanese Unexamined Patent Application Publication No. H05-156330A Patent Document 2: Japanese Unexamined Patent Application Publication No. H03-029131A

SUMMARY OF INVENTION

Technical Problem

However, the powdered coal (blast furnace blowing coal) described in Patent Document 1 causes an increase in running cost because only the powdered coal of which the ash softening point has been adjusted to higher than or equal to 1300° C. by intentionally adding the flux described above to powdered coal is used. Also, since the flux is only calcium oxide, the addition quantity of the flux becomes extremely large depending on the ash composition of the single pulverized coal(s), and there is the possibility of causing a decrease in the amount of heat release of the blast furnace blow-in coal depending on the addition quantity thereof.

In Patent Document 2, described is only a blast furnace operating method which assures fluidity of bosh slag produced in the blast furnace by setting the viscosity at 1450° C. to less than or equal to 10 poise. Therefore, there is the possibility that accretion of blast furnace blow-in ash or occlusion by the blast furnace blow-in ash in a pathway leading to the tuyere of the blast furnace main body cannot be suppressed. Furthermore, due to the fact that flux is added, there is the possibility of causing a decrease in the amount of heat release of the blast furnace blow-in coal depending on the addition quantity thereof.

From such facts, the present invention was devised to solve the problems described above, and an object of the present invention is to provide a method for preparing blast furnace blow-in coal that can provide, at a low cost, blast furnace blow-in coal that suppresses occlusion by blast furnace blow-in ash or accretion of blast furnace blow-in ash in a pathway leading to a tuyere of a blast furnace main body, while suppressing a decrease in the amount of heat release.

Solution to Problem

The method for preparing blast furnace blow-in coal pertaining to the first invention which solves the above problems is a method for preparing blast furnace blow-in coal blown from a tuyere into an interior of a blast furnace main body of a blast furnace installation, the method comprising: a first step of analyzing a moisture content of run-of-mine coal, ash of the coal, and weight percentages of Al, Si, Ca and Mg in the ash; a second step of selecting, on the basis of data obtained by analysis, a first coal type, of which the moisture content in the run-of-mine coal is greater than or equal to 15% by weight, and, when the total of Al, Si, Ca and Mg oxides in the ash is taken as 100% by weight, the $Al_2O_3$ content is 20% by weight ±5% by weight, the CaO content is greater than or equal to 20% by weight and less than or equal to 40% by weight, and the MgO content is less than or equal to 10% by weight; a third step of selecting, on the basis of data obtained by analysis, a second coal type in that, when the total weight of Al, Si, Ca and Mg oxides in that ash is taken as 100% by weight, the $Al_2O_3$ content is 20% by weight ±5% by weight, the CaO content is greater than or equal to 40% by weight, and the MgO content is less than or equal to 10% by weight; a fourth step of deriving a mixing ratio of the first coal type and the second coal type that results in the CaO content in the ash of mixed coal resulting from mixing the first coal type and the second coal type being greater than or equal to 40% by weight, on the basis of the CaO content in the ash of the first coal type when the total weight of Al, Si, Ca and Mg oxides in that ash is taken as 100% by weight and the $Al_2O_3$ content in that ash is taken as 20% by weight, and on the basis of the CaO content in the ash of the second coal type when the total weight of Al, Si, Ca and Mg oxides in that ash is taken as 100% by weight and the $Al_2O_3$ content in that ash is taken as 20% by weight; and a fifth step of mixing the first coal type and the second coal type in the mixing ratio.

The method for preparing blast furnace blow-in coal pertaining to the second invention which solves the above problems is the method for preparing blast furnace blow-in coal pertaining to the first invention described above, having a sixth step of pyrolyzing the mixed coal resulting from mixing the first coal type and the second coal type.

The method for preparing blast furnace blow-in coal pertaining to the third invention which solves the above problems is the method for preparing blast furnace blow-in coal pertaining to the first invention described above, having a pretreatment step of separately pyrolyzing the first coal type and the second coal type, performed before the fifth step, and a seventh step of molding the mixed coal, performed after the fifth step.

Advantageous Effects of Invention

By the method for preparing blast furnace blow-in coal pertaining to the present invention, it is possible to obtain, at a low cost, blast furnace blow-in coal that suppresses occlusion by blast furnace blow-in ash or accretion of blast furnace blow-in ash in a pathway leading to a tuyere of a blast furnace main body, while suppressing a decrease in the amount of heat release.

DESCRIPTION OF EMBODIMENTS

Embodiments of the method for preparing blast furnace blow-in coal pertaining to the present invention will be described based on the drawings, but the present invention is not limited only to the following embodiments described based on the drawings.

An embodiment of the method for preparing blast furnace blow-in coal pertaining to the present invention will be described based on FIGS. 1 and 2.

Figure 1:
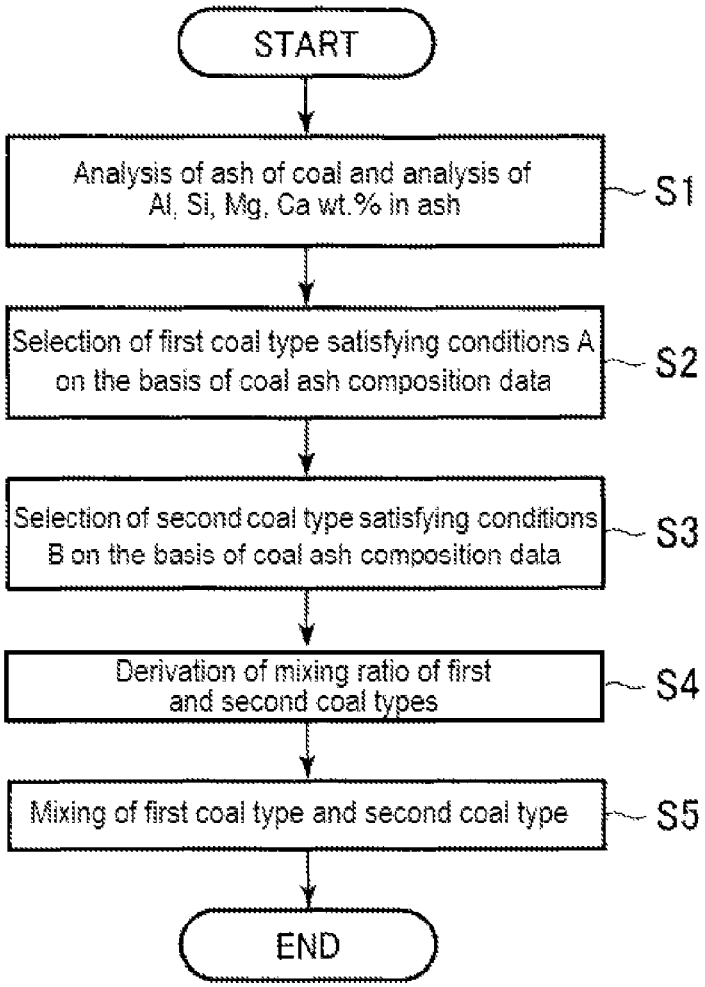
FIG. 1 is a flowchart illustrating a procedure of a method for preparing blast furnace blow-in coal pertaining to an embodiment of the present invention.

The blast furnace blow-in coal pertaining to this embodiment is blast furnace blow-in coal blown from a tuyere into the interior of a blast furnace main body of a blast furnace installation, which, as illustrated in FIG. 1, can be easily prepared by analyzing the moisture content of run-of-mine coal and the ash of the coal, and analyzing the weight percentages of Al, Si, Ca and Mg in the ash of the coal (first step S1); selecting a low-ash-melting-point first coal type satisfying conditions A (second step S2); selecting a high-ash-melting-point second coal type satisfying conditions B which differ from conditions A (third step S3); deriving a mixing ratio for mixing these coals (first coal type and second coal type) (fourth step S4); and mixing the selected first coal type and the second coal type in that mixing ratio (fifth step S5).

In the first step S1, the moisture content of run-of-mine coal and the composition of the ash of the coal are the data most basically used as the quality of coal (run-of-mine coal), and are obtained by, for example, the industrial analysis set forth in JIS M 8812 (2004) implemented when the run-of-mine coal is produced or used.

In the first step S1, the weight percentages of Al, Si, Ca and Ma in the ash of the coal are the data most basically used as the quality of coal (run-of-mine coal), and are obtained by, for example, the analysis method of metal in exhaust gas set forth in JIS K 0083 (method by ICP (high-frequency inductively coupled plasma)) or the analysis method of coal ash and coke ash set forth in JIS M 8815 implemented when the run-of-mine coal is produced or used.

Figure 2:
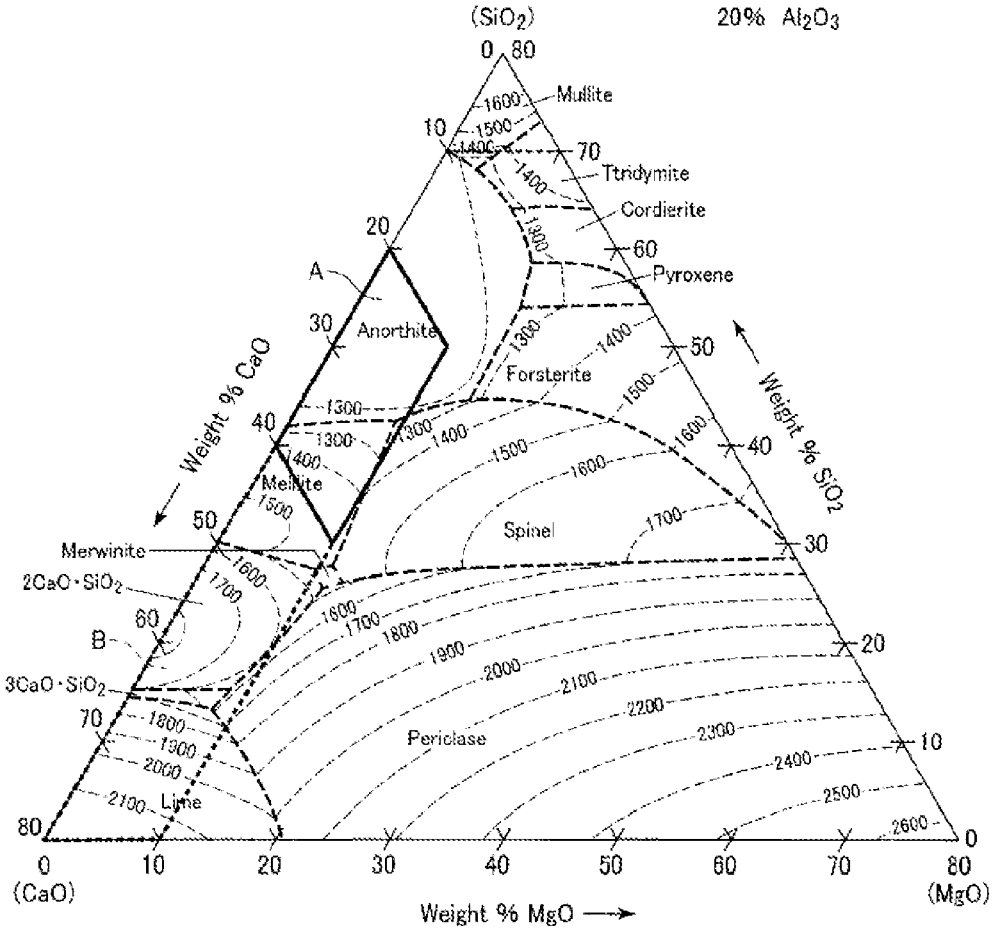
FIG. 2 is a quaternary phase diagram for $SiO_2$—CaO—MgO-20% $Al_2O_3$ when the total weight of Al, Si, Ca and Mg oxides in the ash of the mixed coal used in the method for preparing blast furnace blow-in coal pertaining to an embodiment of the present invention is taken as 100% by weight and the $Al_2O_3$ content is taken as 20% by weight.

Conditions A in the second step S2 are that the moisture content of the run-of-mine coal is greater than or equal to 15% by weight, and, as illustrated in FIG. 2, when the total of Al, Si, Ca and Mg oxides in the ash is taken as 100% by weight, the $Al_2O_3$ content is 20% by weight ±5% by weight, the CaO content is greater than or equal to 20% by weight and less than or equal to 40% by weight, and the MgO content is less than or equal to 10% by weight.

Examples of run-of-mine coal of the first coal type satisfying conditions A are generally low-grade coals (oxygen atom content (dry base): greater than 18% by weight; average pore diameter: from 3 to 4 nm) having a low ash melting point (for example, 1200° C.), such as lignite, sub-bituminous coal, bituminous coal, and the like. Other coals that may be used include pyrolyzed coals, specifically those having an oxygen atom content (dry base) of from 10 to 18% by weight, which has been greatly reduced by desorption of tar-producing groups such as oxygen-containing functional groups (carboxyl groups, aldehyde groups, ester groups, hydroxyl groups, and the like), specifically those in which decomposition (reduction) of the main skeleton (combustion components of mainly C, H, O) has been greatly suppressed, and having an average pore diameter of from 10 to 50 nm by means of removing moisture by heating (from 110 to 200° C. for from 0.5 to 1 hour) low-grade coal in a low-oxygen atmosphere (oxygen concentration: less than or equal to 5% by volume) to dry it, and then removing water, carbon dioxide, tar and the like as pyrolyzed gas or pyrolyzed oil by pyrolysis while heating (from 460 to 590° C. (preferably from 500 to 550° C.) for from 0.5 to 1 hour) in a low-oxygen atmosphere (oxygen concentration: less than or equal to 2% by volume), and then cooling (lower than or equal to 50° C.) in a low-oxygen atmosphere (oxygen concentration: less than or equal to 2% by volume).

Conditions B in the third step S3 are that, as illustrated in FIG. 2, when the total of Al, Si, Ca and Mg oxides in the ash is taken as 100% by weight, the $Al_2O_3$ content is 20% by weight ±5% by weight, the CaO content is greater than or equal to 40% by weight, and the MgO content is less than or equal to 10% by weight.

Examples of run-of-mine coal of the second coal type satisfying conditions B are generally low-grade coals having a moisture content of greater than or equal to 15% by weight (oxygen atom content (dry base): greater than 18% by weight; average pore diameter: from 3 to 4 nm) having a low ash melting point (for example, 1200° C.), such as lignite, sub-bituminous coal, bituminous coal and the like, but are not limited to high-grade coals having a moisture content of less than 15% by weight. Other coals that may be used include pyrolyzed coals, specifically those having an oxygen atom content (dry base) of from 10 to 18% by weight, which has been greatly reduced by desorption of tar-producing groups such as oxygen-containing functional groups (carboxyl groups, aldehyde groups, ester groups, hydroxyl groups and the like), specifically those in which decomposition (reduction) of the main skeleton (combustion components of mainly C, H, O) has been greatly suppressed, and having an average pore diameter of from 10 to 50 nm by means of removing moisture by heating (from 110 to 200° C. for from 0.5 to 1 hour) low-grade coal in a low-oxygen atmosphere (oxygen concentration: less than or equal to 5% by volume) to dry it, and then removing water, carbon dioxide, tar and the like as pyrolyzed gas or pyrolyzed oil by pyrolysis while heating (from 460 to 590° C. (preferably from 500 to 550° C.) for from 0.5 to 1 hour) in a low-oxygen atmosphere (oxygen concentration: less than or equal to 2% by volume), and then cooling (lower than or equal to 50° C.) in a low-oxygen atmosphere (oxygen concentration: less than or equal to 2% by volume).

In the fourth step S4, as the mixing ratio of the first coal type and the second coal type, on the basis of the ash composition data of the first coal type obtained in the first step S1, the CaO content in the ash of the first coal type is derived when the total weight of Al, Si, Ca, and Mg oxides in the ash of the first coal type is taken as 100% by weight and the $Al_2O_3$ content in that ash is taken as 20% by weight, and, on the basis of the ash composition data of the second coal type obtained in the first step S1, the CaO content in the ash of the second coal type is derived when the total weight of Al, Si, Ca and Mg oxides in the ash of the second coal type is taken as 100% by weight and the $Al_2O_3$ content in that ash is taken as 20% by weight, and, on the basis of the CaO content in the ash of the first coal type and the CaO content in the ash of the second coal type, the mixing ratio that results in the CaO content in the ash of mixed coal resulting from mixing the first coal type and the second coal type being greater than or equal to 40% by weight is derived.

In the fifth step S5, blast furnace blow-in coal is prepared by mixing the first coal type selected in the second step S2 and the second coal type selected in the third step S3 in the mixing ratio derived in the fourth step S4.

Because the blast furnace blow-in coal produced by the method for preparing blast furnace blow-in coal pertaining to this embodiment is a mixed coal of the first coal type satisfying conditions A and the second coal type satisfying conditions B mixed in a mixing ratio that results in the CaO weight in the ash of the mixed coal being greater than or equal to 40% by weight when the total of Al, Si, Ca and Mg oxides in the ash of the mixed coal of the first coal type and the second coal type is taken as 100% by weight and the $Al_2O_3$ content in the ash is taken as 20% by weight, the ash melting point of the blast furnace blow-in coal is from 100 to 150° C. higher than the temperature of the hot air blown into the interior from the tuyere of the blast furnace main body and the ash of blast furnace blow-in coal (blast furnace blow-in ash) does not melt by the hot air, and as a result, it can suppress accretion of blast furnace blow-in ash or occlusion by the blast furnace blow-in ash in the pathway leading to the tuyere of the blast furnace main body.

For this reason, with the blast furnace blow-in coal pertaining to this embodiment, simply mixing the first coal type and the second coal type and causing the CaO content in the ash of the mix coal obtained by mixing the first coal type and the second coal type to be greater than or equal to 40% by weight results in the ash melting point of the mixed coal being higher than or equal to 1400° C. despite containing a low-ash-melting-point first coal type, and as a result, there is no need to add an additive such as calcium oxide to the coal, and therefore, a decrease in the amount of heat release due to addition of the additive does not occur, and a decrease in the amount of heat release of the obtained blast furnace blow-in coal can be suppressed.

Therefore, by the method for preparing blast furnace blow-in coal pertaining to this embodiment, it is possible to obtain, at a low cost, blast furnace blow-in coal that suppresses accretion of blast furnace blow-in ash or occlusion by blast furnace blow-in ash in a pathway leading to a tuyere of a blast furnace main body while suppressing a decrease in the amount of heat release.

EXAMPLES

Working examples performed to confirm the operation and effect of the method for preparing blast furnace blow-in coal pertaining to the present invention will be described below, but the present invention is not limited to only the following working examples described based on various data.

First, as illustrated in FIG. 1, the moisture content of run-of-mine coal and the ash of the coal are analyzed, and the weight percentages of Al, Si, Ca and Mg in the ash of the coal are analyzed in advance (first step S1), a first coal type satisfying conditions A is selected (second step S2), and a second coal type satisfying conditions B different from conditions A is selected (third step S3). In this working example, coal type 1 shown in Table 1 below was selected as the first coal type satisfying conditions A, and coal type 2 shown in Table 1 below was selected as the second coal type satisfying conditions B.

TABLE 1

| | | Units | Coal type 1 | Coal type 2 |
|---|---|---|---|---|
| Ash composition | $SiO_2$ | wt % | 31.7 | 17.9 |
| | $Al_2O_3$ | wt % | 17.2 | 14.1 |
| | $TiO_2$ | wt % | 1.34 | 0.87 |
| | $Fe_2O_3$ | wt % | 5.98 | 7.34 |
| | CaO | wt % | 22.9 | 33.2 |
| | MgO | wt % | 5.11 | 7.27 |
| | $Na_2O$ | wt % | 1.4 | 1.87 |
| | $K_2O$ | wt % | 0.42 | 0.34 |
| | $SO_3$ | wt % | 9.36 | 9.99 |
| | $P_2O_3$ | wt % | 0.88 | 2.02 |
| | Total of $SiO_2$, $Al_2O_3$, CaO and MgO | wt % | 76.91 | 72.47 |
| | $SiO_2$ (as converted when $SiO_2$, $Al_2O_3$, CaO and MgO total 100 wt %) | wt % | 41.2 | 24.7 |
| | $Al_2O_3$ (as converted when $SiO_2$, $Al_2O_3$, CaO and MgO total 100 wt %) | wt % | 22.4 | 19.5 |
| | CaO (as converted when $SiO_2$, $Al_2O_3$, CaO and MgO total 100 wt %) | wt % | 29.8 | 45.8 |
| | MgO (as converted when $SiO_2$, $Al_2O_3$, CaO and MgO total 100 wt %) | wt % | 6.6 | 10.0 |
| | $SiO_2$ (as converted when $SiO_2$, CaO and MgO total 80 wt %) | wt % | 42.47 | 24.5 |
| | CaO (as converted when $SiO_2$, CaO and MgO total 80 wt %) | wt % | 30.72 | 45.5 |
| | MgO (as converted when $SiO_2$, CaO and MgO total 80 wt %) | wt % | 6.8 | 9.9 |

Figure 3:
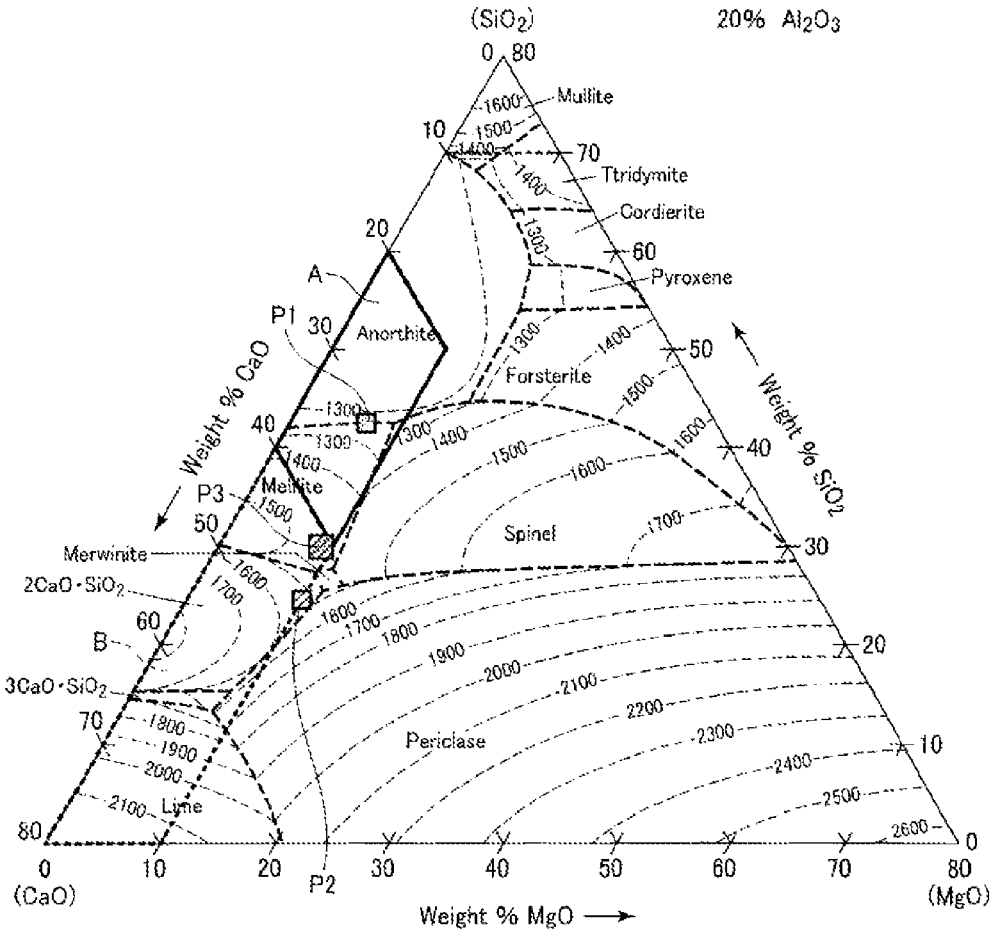
FIG. 3 is a quaternary phase diagram for $SiO_2$—CaO—MgO-20% $Al_2O_3$ used for describing a confirmation test of the method for preparing blast furnace blow-in coal pertaining to the working example of the present invention.

When the total weight of Al, Si, Ca and Mg oxides in the ash of coal type 1 was taken as 100% by weight and the $Al_2O_3$ content was converted to 20% by weight, the contents of Si, Ca and Mg oxides in the ash of coal type 1 were the values shown in Table 1 above. Thus, the ash melting point of coal type 1 is positioned at point P1 in FIG. 3, which is a quaternary phase diagram for $SiO_2$—CaO—MgO-20% $Al_2O_3$ when the total of Al, Si, Ca and Mg oxides in the ash of the coal is taken as 100% by weight and the $Al_2O_3$ content is converted to 20% by weight.

When the total weight of Al, Si, Ca and Mg oxides in the ash of coal type 2 was taken as 100% by weight and the $Al_2O_3$ content was converted to 20% by weight, the contents of Si, Ca and Mg oxides in the ash of coal type 2 were the values shown in Table 1 above. Thus, the ash melting point of coal type 2 is positioned at point P2 in FIG. 3.

Then, a mixing ratio of the first coal type and the second coal type that results in the CaO content in the ash of mixed coal resulting from mixing the first coal type and the second coal type being greater than or equal to 40% by weight is derived, on the basis of the CaO content in the ash of the first coal type when the total weight of Al, Si, Ca and Mg oxides in that ash is taken as 100% by weight and the $Al_2O_3$ content in that ash is taken as 20% by weight, and on the basis of the CaO content in the ash of the second coal type when the total weight of Al, Si, Ca and Mg oxides in that ash is taken as 100% by weight and the $Al_2O_3$ content in that ash is converted to 20% by weight. In this working example, the mixing ratio of coal type 1 is 30% by weight, and the mixing ratio of coal type 2 is 70% by weight. A blast furnace blow-in coal consisting of a mixed coal resulting from mixing coal type 1 in a ratio of 30% by weight and coal type 2 in a ratio of 70% by weight was used as test substance 1.

When the total of Al, Si, Ca and Mg oxides in the ash of test substance 1 was taken as 100% by weight and the $Al_2O_3$ content was converted to 20% by weight, the contents of Si, Ca and Mg oxides in the ash of test substance 1 were the values shown in Table 2 below. Thus, the ash melting point of test substance 1 is positioned at point P3 in FIG. 3, and it is clear that the ash melting point P3 of test substance 1 is positioned in a region in which the ash melting point of coal is higher than or equal to 1400° C.

TABLE 2

| | Test substance 1 |
|---|---|
| $SiO_2$ (as converted when $SiO_2$, CaO and MgO total 80 wt %) | 30 |
| CaO (as converted when $SiO_2$, CaO and MgO total 80 wt %) | 41 |
| MgO (as converted when $SiO_2$, CaO and MgO total 80 wt %) | 9 |

Thus, it is clear that by this working example, it is possible to obtain, at low cost, blast furnace blow-in coal that suppresses accretion of blast furnace blow-in ash or occlusion by blast furnace blow-in ash in a pathway leading to a tuyere of a blast furnace main body while suppressing a decrease in the amount of heat release despite containing low-ash-melting-point coal, by analyzing a moisture content of run-of-mine coal, ash of the coal, and the weight percentages of Al, Si, Ca and Mg in the ash of the coal; selecting a first coal type satisfying conditions A, and selecting a second coal type satisfying conditions B which differ from conditions A; deriving a mixing ratio of the first coal type and the second coal type that results in the CaO content in the ash of mixed coal resulting from mixing the first coal type and the second coal type being greater than or equal to 40% by weight, on the basis of the CaO content in the ash of the first coal type when the total weight of Al, Si, Ca and Mg oxides in that ash is taken as 100% by weight and the $Al_2O_3$ content in that ash is taken as 20% by weight, and on the basis of the CaO content in the ash of the second coal type when the total weight of Al, Si, Ca and Mg oxides in that ash is taken as 100% by weight and the $Al_2O_3$ content in that ash is taken as 20% by weight; and mixing the first coal type and the second coal type in the mixing ratio to obtain mixed coal.

[Other Embodiments]

Furthermore, a method for preparing blast furnace blow-in coal in which the third step S3 is performed after the second step S2 was described above, but a method for preparing blast furnace blow-in coal in which the second step S2 and the third step S3 are performed simultaneously, or a method for preparing blast furnace blow-in coal in which the second step S2 is performed after the third step S3, may also be used.

A method for preparing blast furnace blow-in coal that provides blast furnace blow-in coal by performing the first step S1 to the fifth step S5 was described above, but a method for preparing blast furnace blow-in coal that provides blast furnace blow-in coal by performing a pyrolysis step, wherein the mixed coal is simultaneously pyrolyzed (heated in a low-oxygen atmosphere (oxygen concentration: less than or equal to 2% by volume) from 460 to 590° C. (preferably from 500 to 550° C.) for from 0.5 to 1 hour) in the same pyrolysis device (pyrolysis means), as a sixth step S6 after performing the first step S1 to the fifth step S5, may also be used. By such a method for preparing blast furnace blow-in coal, it is possible to obtain blast furnace blow-in coal that not only exhibits the same actions and effects as the embodiments described above, but also has had its combustibility improved immediately before being blown into the interior from the tuyere of the blast furnace main body.

Furthermore, a method for preparing blast furnace blow-in coal that provides blast furnace blow-in coal by performing a pyrolysis step, wherein the first coal type and the second coal type are pyrolyzed (heated in a low-oxygen atmosphere (oxygen concentration: less than or equal to 2% by volume) from 460 to 590° C. (preferably from 500 to 550° C.) for from 0.5 to 1 hour) in separate pyrolysis devices (pyrolysis means), as a pretreatment step after the first step S1 to fourth step S4, in other words, before the fifth step S5, and then performing a molding step as a seventh step S7 performed after the fifth step S5, wherein a binder (for example, corn starch, molasses, asphalt or the like) and water and the like are added to the pyrolyzed mixed coal which is then molded, may also be used. By such a method for preparing blast furnace blow-in coal, it is possible to easily obtain blast furnace blow-in coal that not only exhibits the same actions and effects as the embodiments described above, but also has improved ease of handling.

INDUSTRIAL APPLICABILITY

The method for preparing blast furnace blow-in coal pertaining to the present invention can be used extremely advantageously in the iron-making industry because it can, at a low cost, provide blast furnace blow-in coal that suppresses occlusion by blast furnace blow-in ash or accretion of blast furnace blow-in ash in a pathway leading to a tuyere of a blast furnace main body.

REFERENCE SIGNS LIST

A Conditions of first coal type
B Conditions of second coal type
P1 Ash melting point of coal type 1
P2 Ash melting point of coal type 2
P3 Ash melting point of test substance 1
S1 First step (analysis step)
S2 Second step (first coal type selection step)
S3 Third step (second coal type selection step)
S4 Fourth step (mixing ratio specification step)
S5 Fifth step (mixing step)

The invention claimed is:

1. A method for preparing blast furnace blow-in coal, the method comprising:

a first step of analyzing a moisture content of run-of-mine coal, ash of the coal, and weight percentages of Al, Si, Ca and Mg in the ash;

a second step of selecting, based on data obtained by analysis, a first coal type, of which the moisture content of the run-of-mine coal is greater than or equal to 15% by weight, and, when a total of Al, Si, Ca and Mg oxides in the ash is taken as 100% by weight, an $Al_2O_3$ content is 20% by weight ±5% by weight, a CaO content is greater than or equal to 20% by weight and less than or equal to 40% by weight, and an MgO content is less than or equal to 10% by weight;

a third step of selecting, based on data obtained by analysis, a second coal type, of which, when the total of Al, Si, Ca and Mg oxides in the ash is taken as 100% by weight, the $Al_2O_3$ content is 20% by weight ±5% by weight and is adapted to be 20% by weight upon mixing with the first coal type, the CaO content is greater than or equal to 40% by weight, and the MgO content is less than or equal to 10% by weight;

a fourth step of deriving a mixing ratio of the first coal type and the second coal type that results in the CaO content being greater than or equal to 40% by weight in the ash of mixed coal resulting from mixing the first coal type and the second coal type, based on the CaO content in the ash of the first coal type when the total weight of Al, Si, Ca and Mg oxides in that ash is taken as 100% by weight and the $Al_2O_3$ content in that ash is taken as 20% by weight, and based on the CaO content in the ash of the second coal type when the total weight of Al, Si, Ca and Mg oxides in that ash is taken as 100% by weight and the $Al_2O_3$ content in that ash is taken as 20% by weight; and a fifth step of mixing the first coal type and the second coal type in the mixing ratio.

2. The method for preparing blast furnace blow-in coal according to claim 1, further comprising a sixth step of pyrolyzing the mixed coal resulting from mixing the first coal type and the second coal type.

3. The method for preparing blast furnace blow-in coal according to claim 1, further comprising a pretreatment step of separately pyrolyzing the first coal type and the second coal type, which is performed before the fifth step; and a seventh step of molding the mixed coal, which is performed after the fifth step.

* * * * *